US005887625A

United States Patent [19]

Takahashi

[11] Patent Number: 5,887,625

[45] Date of Patent: Mar. 30, 1999

[54] FLAT PIPE

[76] Inventor: Kei Takahashi, 1-14-16 Achi, Kurashiki, Okayama 710, Japan

[21] Appl. No.: 801,431

[22] Filed: Feb. 17, 1997

[30] Foreign Application Priority Data

Feb. 28, 1996 [JP] Japan ..... 8-069038

[51] Int. Cl.[6] ..... F15D 1/14

[52] U.S. Cl. ..... 138/38; 138/116; 138/177; 165/166

[58] Field of Search ..... 138/113, 177, 138/115, 116, 117, 108, 38, 42; 165/170, 166

[56] References Cited

U.S. PATENT DOCUMENTS

| | | | |
|---|---|---|---|
| 1,251,393 | 12/1917 | Longley | 138/144 |
| 1,961,660 | 6/1934 | Fehrmann | 165/170 |
| 4,442,886 | 4/1984 | Dinulescu | 165/166 |
| 4,529,414 | 7/1985 | Naess | 138/115 |
| 4,622,138 | 11/1986 | Wager | 405/43 |
| 5,025,856 | 6/1991 | Van Dyke et al. | 165/166 |
| 5,181,562 | 1/1993 | Kuriki | 165/166 |
| 5,704,423 | 1/1998 | Letrange | 138/117 |
| 5,730,215 | 3/1998 | Hirano et al. | 165/170 |

FOREIGN PATENT DOCUMENTS

| | | | |
|---|---|---|---|
| 403286995 A | 12/1991 | Japan | 165/166 |
| 1143965 | 3/1985 | U.S.S.R. | 165/166 |

*Primary Examiner*—Denise L. Ferensic
*Assistant Examiner*—James F. Hook
*Attorney, Agent, or Firm*—Carrier, Blackman & Associates, P.C.; Joseph P. Carrier; William D. Blackman

[57] ABSTRACT

A flat pipe includes a hollow body having a pair of upper and lower walls extending substantially parallel to each other, and opposite lateral sides joined thereto, and a plurality of spacers closely fit between the upper and lower walls of the body and interconnected by a permeable sheet. The spacers are arranged at equal intervals to define a plurality of parallel fluid passages. The spacers are fused to opposite sides of the sheet in alternating relationship so that the sheet is inclined between adjacent spacers. The spacers are resistant to compression and deformation.

17 Claims, 4 Drawing Sheets

FLAT PIPE

BACKGROUND OF THE INVENTION

1. Field of the Invention

The present invention relates to flat pipes and more particularly, to an arrangement for improving the mechanical strength of a flat pipe.

2. Description of the Related Art

Flat pipes are typically employed in heat exchanger technology. FIG. 8 illustrates one example of a flat pipe known in the art. As shown, the flat pipe has a continuous wall, opposite lateral ends of which are inwardly bent at the center of the pipe to provide opposite flanges. The flanges are welded together to form a longitudinally extending partition whereby the interior of the flat pipe is divided into two fluid passages. Typically, the flat pipe has a width of 3 to 4 cm, and a thickness of 2 to 5 mm. With such an arrangement, if the width of the flat pipe is increased, the resulting flat pipe is likely to become deformed under the influence of thermal stress during use. Such deformation has a detrimental effect on the heat transfer performance of the flat pipe. As such, the ratio of width to thickness in the prior art flat pipe is limited to between 1 and 20.

Accordingly, it is an object of the present invention to provide a flat pipe which has improved resistance to compression and deformation.

It is another object of the present invention to provide a flat pipe wherein the ratio of width to thickness can be greater than 20.

SUMMARY OF THE INVENTION

According to one aspect of the present invention, there is provided a flat pipe comprising a hollow body having a pair of first and second walls extending substantially parallel to each other and opposite lateral sides connected thereto, and spacer means for maintaining a space between the first and second walls. The spacer means includes a plurality of spacers placed in tight contact with the first and second walls and preferably fused thereto. The spacers are made of a material which is resistant to compression and deformation. A permeable sheet is adapted to interconnect the spacers to hold them in position. The sheet cooperates with the spacers to resist bending or deformation of the flat pipe.

The spacers may be fused or otherwise secured to opposite sides of the sheet in aligned opposing relationship so that the sheet extends substantially in parallel to the first and second walls. With this arrangement, the sheet creates a laminar flow along the fluid passages. The sheet also serves as a heat transfer element. Alternatively, the spacers may be fused to opposite sides of the sheet in alternating relationship so that the sheet is inclined between each adjacent spacers. With this alternative arrangement, the inclined or undulating sheet promotes convection through the sheet between adjacent spacers.

The spacers may be permeable or have lateral grooves so as to provide a communication between adjacent fluid passages.

The sheet may be made of woven fabric, unwoven fabric or knitted fabric. The spacers may be made of ceramic, resin or fabric.

According to another aspect of the invention, there is provided a flat pipe comprising a hollow body having a pair of substantially flat upper and lower walls extending substantially parallel to each other, and opposite side walls joined to the upper and lower walls, and spacer means for maintaining a space between the upper and lower walls. The spacer means includes a plurality of permeable sheets arranged one above the other and extending substantially parallel to each other, and a plurality of spacers placed between adjacent sheets and arranged in spaced-apart aligned relationship. The spacers are made of a material which resists a compression force.

BRIEF DESCRIPTION OF THE DRAWINGS

The present invention will now be described by way of example with reference to the accompanying drawings, in which.

DESCRIPTION OF THE PREFERRED EMBODIMENTS

Figure 1:
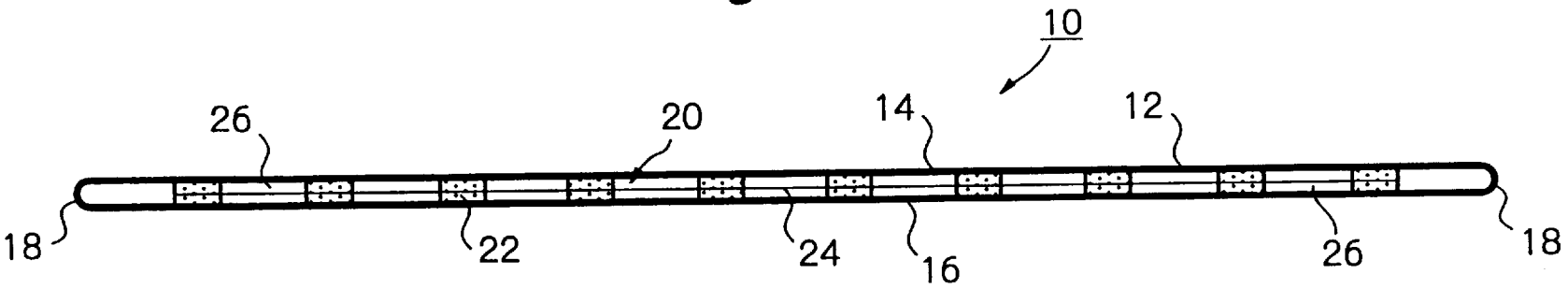
FIG. 1 is a sectional view of a flat pipe made according to one embodiment of the present invention.

Referring now to FIG. 1, there is shown a flat pipe made according to one embodiment of the present invention. Specifically, a flat pipe 10 has a hollow body 12. The body 12 has a rectangular section and includes an upper wall 14, a lower wall 16 extending substantially parallel to the upper wall 14, and side walls 18, 18 located at opposite sides of the body 12 and joined to the upper wall 14 and the lower wall 16. Illustratively, the body 12 is integrally made of resin. A metal layer (not shown) may be laminated to the outer surface of the body 12. Alternatively, the body 12 may be made of metal or other materials. In the illustrated embodiment, the flat pipe 10 has a width of 410 mm, and a thickness of 7 mm (the ratio of width to thickness is approximately 60). This flat pipe 10 may be used as a heat exchanger and typically, mounted onto the external roof of a house so as to collect heat or melt snow.

Figure 2:
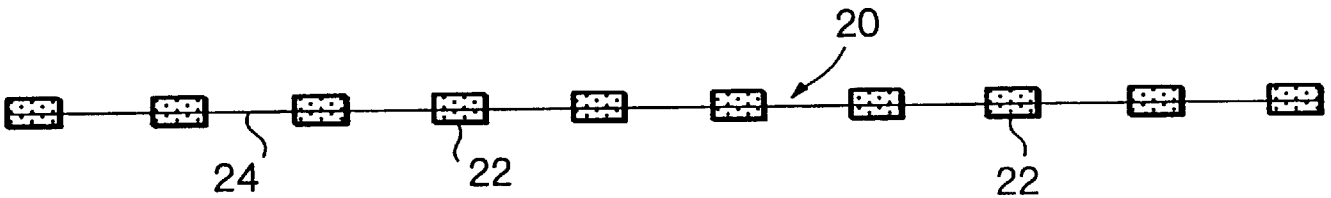
FIG. 2 is an end view of spacer means inserted within the flat pipe shown in FIG. 1.

As a feature of the present invention, a single spacer means 20 is inserted within the body 12 so as to maintain the space between the upper wall 14 and the lower wall 16 of the body. Referring specifically to FIG. 2, a plurality of spacers 22 extend along the length of the body 12 and are closely fit between the upper wall 12 and the lower wall 14 of the body 12. The spacers 22 are arranged at regular intervals along the width of the body 12 and interconnected by a substantially flat sheet 24 so as to define a plurality of parallel fluid passages 26. The spacers 22 are fused or otherwise secured to opposite sides of the sheet 24 in aligned opposing relationship. The spacers 22 are resistant to compression and deformation and are preferably permeable. The spacers 22 may be made of a suitable material such as ceramic, resin and fabric. The sheet 24 is permeable and preferably made of woven or unwoven fabric, knitted fabric or similar materials. As the sheet 24 extends parallel to the upper and lower walls of the body 12, water or other flowing fluid medium, after introduced into the flat pipe, flows therethrough to create a laminar flow along the passages 26.

Figure 3:
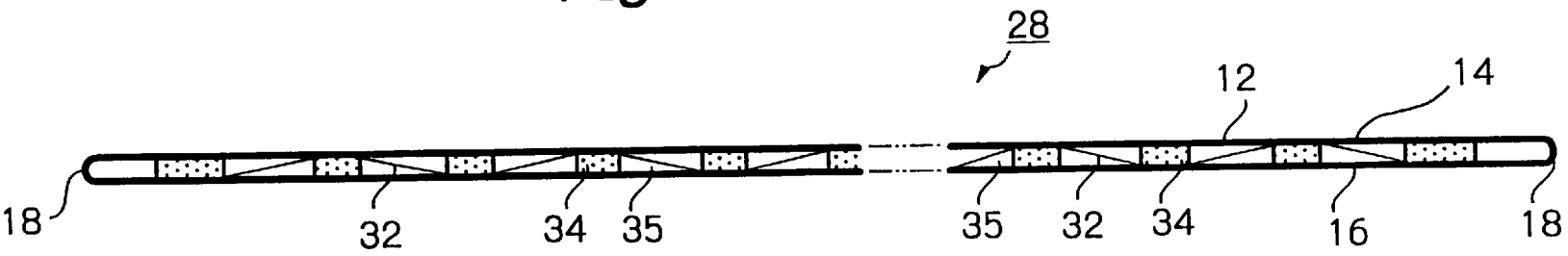
FIG. 3 is a sectional view of a flat pipe made according to another embodiment of the present invention.
Figure 4:
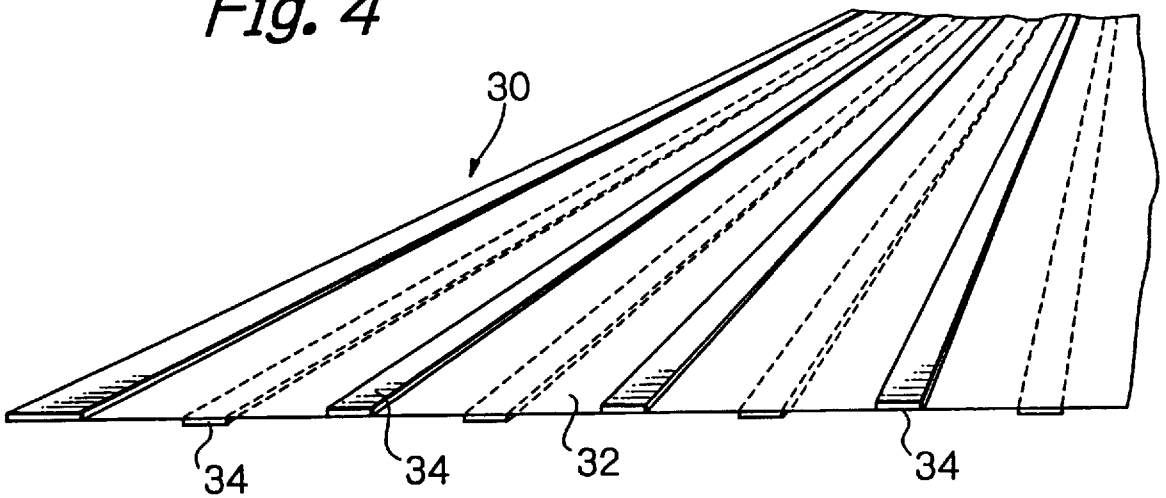
FIG. 4 is a perspective view, in part, of spacer means inserted within the flat pipe shown in FIG. 3.

Referring to FIG. 3, there is shown a flat pipe 28 made according to another embodiment of the present invention. Like parts are given like reference numerals used in FIG. 1. In this embodiment, spacer means 30 includes a sheet 32, and a plurality of elongated spacers 34 closely fit between the upper wall 12 and the lower wall 14 of the body 12 and fused or otherwise secured to opposite sides of the sheet 32 in an alternating relationship as shown in FIG. 4. The spacers 34 extend along the length of the body 12 and are arranged at equal intervals to define a plurality of parallel fluid passages 35. Advantageously, when the spacer means 30 is inserted within the body 12, the sheet 32 becomes inclined between adjacent spacers 34 to thereby promote convection through the sheet 32 between adjacent spacers.

Figure 5:
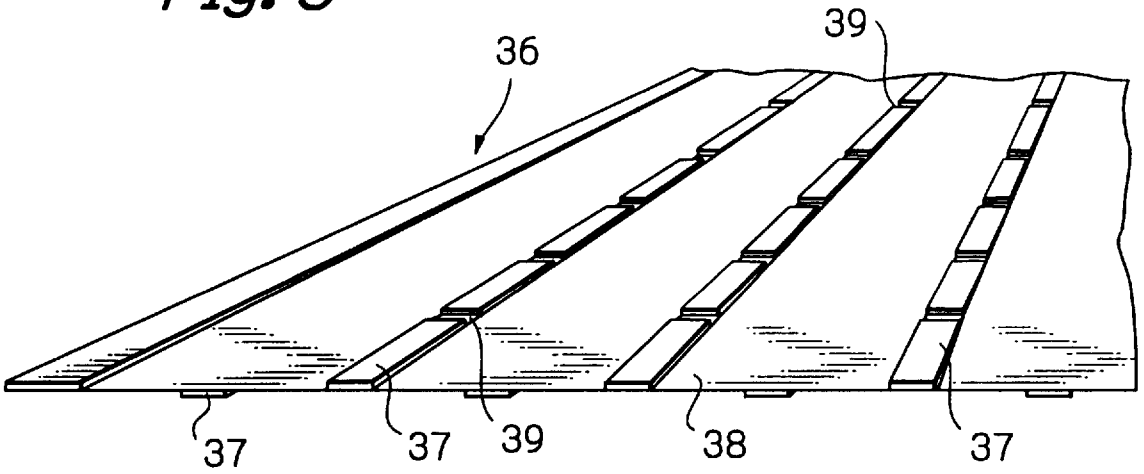
FIG. 5 is a view similar to that shown in FIG. 4, but showing a modified form of the spacer means.

FIG. 5 illustrates a modified form of the spacer means shown in FIG. 4. Specifically, spacer means 36 includes a plurality of parallel spacers 37 interconnected by a sheet 38. A plurality of transverse grooves 39 are formed in the spacers 37 so as to facilitate communication between adjacent fluid passages.

Figure 6:
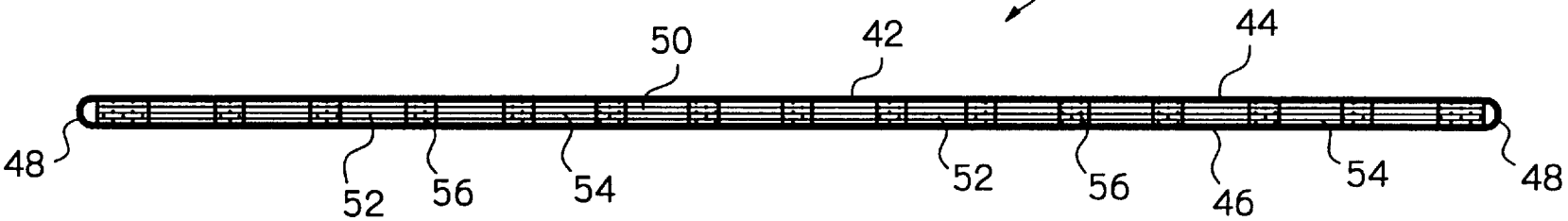
FIG. 6 is a sectional view of a flat pipe made according to a further embodiment of the present invention.
Figures 7, 8:
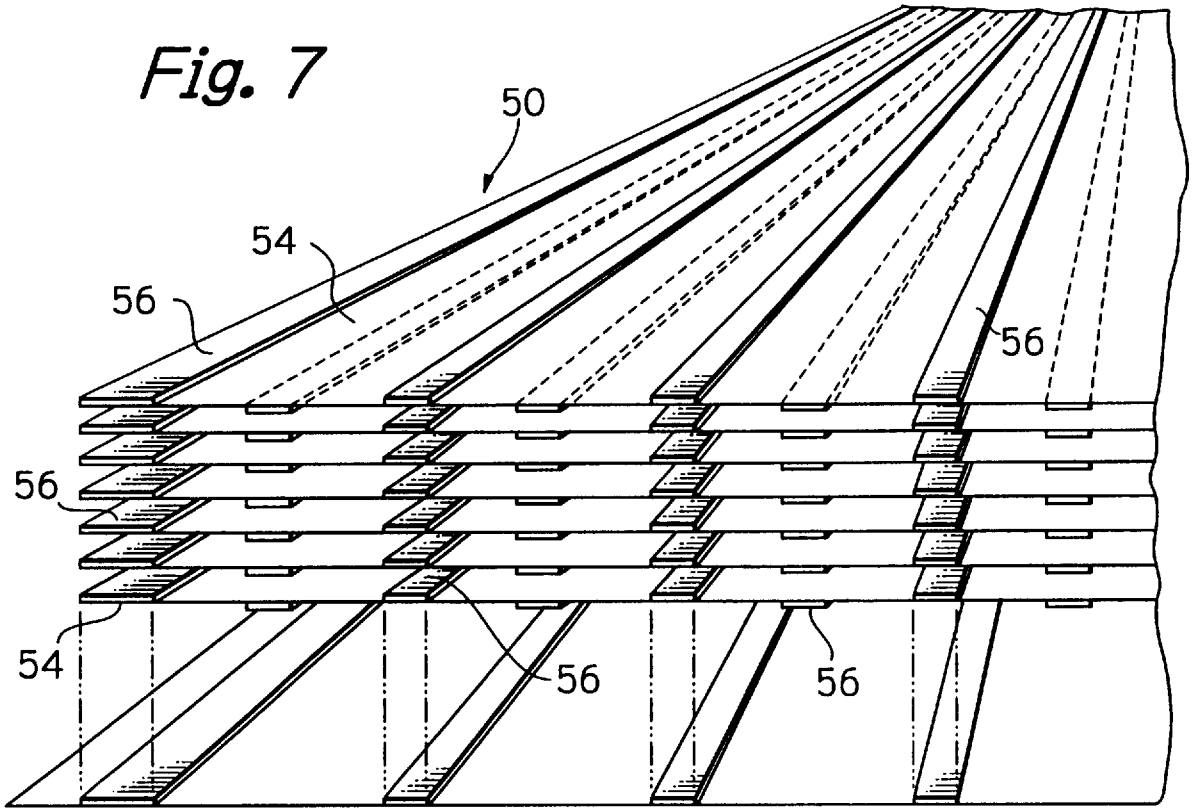
Fig. 8 PRIOR ART
FIG. 7 is an exploded perspective view, in part, of spacer means inserted within the flat pipe shown in FIG. 6.
FIG. 8 is a sectional view of a conventional flat pipe.

Referring to FIG. 6, there is shown a flat pipe made according to a further embodiment of the present invention. Specifically, a flat pipe 40 has a hollow body 42. The body 42 has an upper wall 44, a lower wall 46 extending substantially parallel to the upper wall 44, opposite side walls 48, 48 joined to the upper and lower walls. The body 42 is basically similar in structure to the body 12 shown in FIG. 1, but has a greater thickness to receive a plurality of spacer means 50. The spacer means 50 are sandwiched between the upper and lower walls of the body 42 to define a plurality of parallel fluid passages 52. As shown in FIG. 7, the spacer means 50 include a plurality of sheets 54 arranged one above the other and extending substantially parallel to one another, and a plurality of parallel retainers or spacers 56 vertically aligned with each other. The spacers 56 in each of the sheets 54 are positioned between adjacent spacers in adjacent sheets. All of the spacers 56 are fused or otherwise secured between adjacent sheets. The spacer means 50 thus constructed improve the mechanical strength and resistance to bending of the flat pipe. Also, the sheets 54 are operatively associated so as to more positively create a laminar flow through the fluid passages than that shown in FIG. 1. It should be understood that the spacers 56 may have a plurality of transverse grooves as in the embodiment shown in FIG. 5.

The present invention has been described with respect to its preferred embodiments. It will be understood that various modifications and changes may be made without departing from the scope of the invention as defined by the appended claims.

What is claimed is:

1. A flat pipe comprising:

a hollow body having a pair of first and second walls extending substantially parallel to each other, and opposite lateral sides connected thereto; and spacer means for maintaining a space between said first and second walls, said spacer means comprising a plurality of spacers sandwiched between said first and second walls and arranged at predetermined intervals so as to define a plurality of fluid passages therebetween, said plurality of spacers having a resistance to compression; and a fluid permeable sheet for interconnecting said plurality of spacers, said plurality of spacers being secured to opposite sides of said fluid permeable sheet in aligned relationship, so that said fluid permeable sheet extends substantially parallel to said first and second walls within said hollow body, to thereby create a laminar flow along said plurality of fluid passages.

2. A flat pipe according to claim 1, wherein said plurality of spacers are fluid permeable.

3. A flat pipe according to claim 1, wherein said plurality of spacers are made of a ceramic material.

4. A flat pipe according to claim 1, wherein said plurality of spacers are made of resin.

5. A flat pipe according to claim 1, wherein said plurality of spacers are made of fabric.

6. A flat pipe according to claim 1, wherein said fluid permeable sheet is made of fabric.

7. A flat pipe according to claim 1, wherein said plurality of spacers comprise a plurality of lateral recesses so as to communicate adjacent fluid passages with each other.

8. A flat pipe comprising:

a hollow body having a pair of first and second walls extending substantially parallel to each other, and opposite lateral sides connected thereto; and spacer means for maintaining a space between said first and second walls, said spacer means comprising a plurality of spacers sandwiched between said first and second walls and arranged at predetermined intervals so as to define a plurality of fluid passages therebetween, said plurality of spacers having a resistance to compression; and a fluid permeable sheet for interconnecting said plurality of spacers, said plurality of spacers being secured to opposite sides of said fluid permeable sheet in alternating relationship so that said fluid permeable sheet is inclined between adjacent spacers within said hollow body, to thereby promote convection through said fluid permeable sheet.

9. A flat pipe according to claim 8, wherein said plurality of spacers are fluid permeable.

10. A flat pipe according to claim 8, wherein said plurality of spacers are made of a ceramic material.

11. A flat pipe according to claim 8, wherein said plurality of spacers are made of resin.

12. A flat pipe according to claim 8, wherein said plurality of spacers are made of fabric.

13. A flat pipe according to claim 8, wherein said fluid permeable sheet is made of fabric.

14. A flat pipe according to claim 8, wherein said plurality of spacers comprise a plurality of lateral recesses so as to communicate adjacent fluid passages with each other.

15. A flat pipe comprising:

a hollow body having a pair of substantially flat upper and lower walls extending substantially parallel to each other, and opposite side walls joined thereto; and means for maintaining a space between said upper and lower walls, said means comprising a plurality of fluid permeable sheets arranged one above the other, and a plurality of spacers closely fit between adjacent fluid permeable sheets and arranged in spaced relationship so as to define a plurality of fluid passages therebetween, whereby said plurality of fluid permeable sheets extend substantially parallel to each other within said hollow body so as to create a laminar flow through said plurality of fluid passages.

16. A flat pipe according to claim 15, wherein said plurality of spacers are secured to opposite sides of each of said plurality of fluid permeable sheets in alternating relationship.

17. A flat pipe according to claim 15, wherein said plurality of spacers include a plurality of transverse grooves to allow communication of adjacent fluid passages with each other.

* * * * *

UNITED STATES PATENT AND TRADEMARK OFFICE

CERTIFICATE OF CORRECTION

PATENT NO. : 5,887,625
DATED : 30 March 1999
INVENTOR(S) : Kei Takahashi

It is certified that error appears in the above-identified patent and that said Letters Patent is hereby corrected as shown below:

Column 3, line 63 (claim 1, line 14), after "aligned"
insert --opposing--.

Signed and Sealed this

Twenty-seventh Day of July, 1999

*Attest:*

Q. TODD DICKINSON

*Attesting Officer*

*Acting Commissioner of Patents and Trademarks*